US005256082A

United States Patent [19]

Yaegashi et al.

[11] Patent Number: 5,256,082

[45] Date of Patent: Oct. 26, 1993

[54] COAXIAL RIBBON CABLE CONNECTOR

[75] Inventors: Hirokatsu Yaegashi; Tadahiro Fumikura, both of Tokyo, Japan

[73] Assignee: Hirose Electric Co., Ltd., Tokyo, Japan

[21] Appl. No.: 848,679

[22] Filed: Mar. 9, 1992

[30] Foreign Application Priority Data

Mar. 8, 1991 [JP] Japan ..... 3-20350[U]

[51] Int. Cl.[5] ..... H01R 9/07

[52] U.S. Cl. ..... 439/497; 439/394; 439/510

[58] Field of Search ..... 439/578-585, 439/63, 492, 494, 495, 497, 498, 499, 607, 608, 609, 610, 188, 507, 510, 512, 513

[56] References Cited

U.S. PATENT DOCUMENTS

| | | | |
|---|---|---|---|
| 4,602,830 | 7/1986 | Lockard | 439/497 |
| 4,767,345 | 8/1988 | Gutter et al. | 439/497 |
| 4,773,878 | 9/1988 | Hansell, III | 439/497 |
| 4,850,887 | 7/1989 | Sugawara et al. | 459/497 |
| 4,867,707 | 9/1989 | Widdoes | 439/497 |
| 4,973,264 | 11/1990 | Kamono et al. | 439/497 |
| 5,057,038 | 10/1991 | Bowen et al. | 439/497 |

*Primary Examiner*—David L. Pirlot
*Attorney, Agent, or Firm*—Kanesaka & Takeuchi

[57] ABSTRACT

A coaxial ribbon cable connector (1) consists of a cable connector (2) and a substrate connector (3). The cable connector includes an insulating case (4) having a partition wall (4a); a plurality of signal terminals (8) to which signal lines of a coaxial ribbon cable (11) are connected; a plurality of ground terminals (9) to which drain lines of the cable are connected; the signal and ground terminals being disposed on the partition wall in a back-to-back relationship to form a microstrip line; a plurality of shield terminals (10) disposed between the signal terminals and each having a short-circuit portion (10c) brought into contact with one of the ground terminal. The substrate connector includes an insulating case (33); a plurality of signal terminals (43) arranged within the insulating case; a plurality of ground terminals (44) arranged within the insulating case; a plurality of shield terminals (45) arranged within the insulating case; and the signal, ground, and shield terminals of the substrate connector being brought into contact with the signal, ground and shield terminals of the cable connector such that shield terminals are connected to the ground terminals via contact legs of the shield terminals when the cable connector is plugged into the substrate connector.

1 Claim, 14 Drawing Sheets

COAXIAL RIBBON CABLE CONNECTOR

BACKGROUND OF THE INVENTION

1. Field of the Invention

The present invention relates to backplane mounted coaxial ribbon cable connectors.

2. Description of the Prior Art

FIG. 27 shows a coaxial ribbon cable connector of this type. The connector includes a cable connector 60 and a substrate connector 61 which is mounted on a substrate 62 via a mount 63 such that its signal terminals 64 and ground terminals 65 are connected to a circuit pattern of the substrate 62 via through holes.

FIG. 28 shows the cable connector 60 in section which has a pair of cover members 51 and 52 for holding a coaxial cable 50 between them with a clamp member 55 such that signal lines 54 and drain lines of the coaxial cable 50 engage signal line engaging grooves 53 and drain line engaging grooves formed on the front end and an insulating case 58 which has pin-type signal terminals 56 and ground terminals 57 and is fitted into the cover members 51 and 52 such that the signal lines 54 and the drain lines are connected by insulation displacement to the signal terminals 56 and the ground terminals 57, respectively.

The thus formed cable connector 60 is fitted into the substrate connector 61 so that the respective signal terminals and the ground terminals are brought into contact with the corresponding ones.

However, the distance between the signal terminal and the ground terminal is so large that it is impossible to control the impedance and bring the impedance close to the cable impedance. In addition, the terminals are of the pin type so that it is impossible to shorten the transmission path upon connection (plugging-in), failing to reduce the impedance. Furthermore, there is no shielding between the adjacent signal terminals so that it is impossible to prevent crosstalk between the signals.

SUMMARY OF THE INVENTION

Accordingly, it is an object of the invention to provide a backplane mounted coaxial ribbon cable connector which permits to control the impedance and bring the impedance close to the cable impedance.

It is another object of the invention to provide a backplane mounted coaxial ribbon cable connector which prevents crosstalk between signals.

It is still another object of the invention to provide a backplane mounted coaxial ribbon cable connector which reduces the ground inductance and ground noise.

According to the invention there is provided a coaxial ribbon cable connector consists of a cable connector and a substrate connector. The cable connector includes an insulating case having a partition wall; a plurality of signal terminals to which signal lines of a coaxial ribbon cable are connected; a plurality of ground terminals to which drain lines of the cable are connected; the signal and ground terminals being disposed on the partition wall in a back-to-back relationship to form a microstrip line; a plurality of shield terminals disposed between the signal terminals and each having a short-circuit portion brought into contact with one of the ground terminal. The substrate connector includes an insulating case; a plurality of signal terminals arranged within the insulating case; a plurality of ground terminals arranged within the insulating case; a plurality of shield terminals arranged within the insulating case; and the signal, ground, and shield terminals of the substrate connector being brought into contact with the signal, ground and shield terminals of the cable connector such that shield terminals are connected to the ground terminals via contact legs of the shield terminals when the cable connector is plugged into the substrate connector.

The above and other objects, features, and advantages of the invention will be more apparent from the following description when taken in conjunction with the accompanying drawings.

DESCRIPTION OF THE PREFERRED EMBODIMENT

Figure 1:
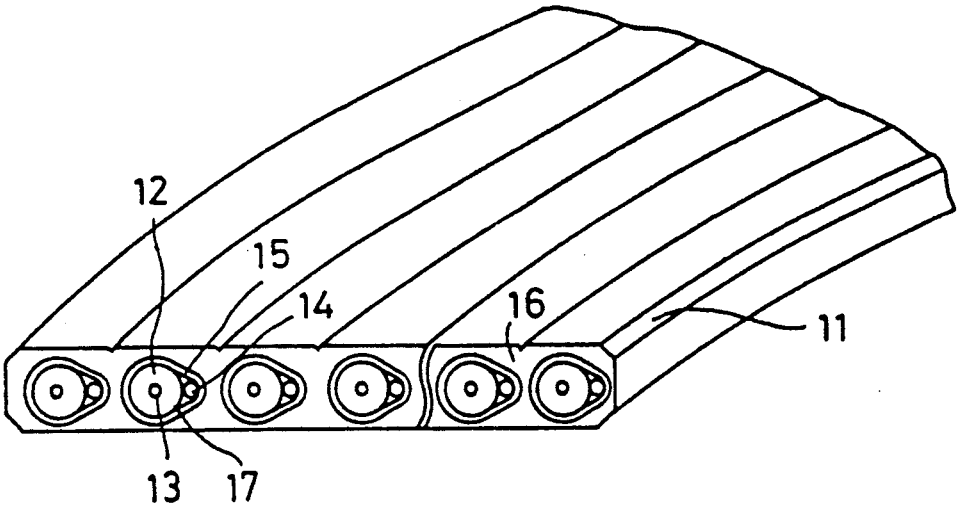
FIG. 1 is a perspective view of a coaxial ribbon cable.

In FIG. 1, a coaxial ribbon cable 11 includes an insulating jacket 16 and a number of shielded wires arranged side by side in the jacket, with each made up of a signal line 17 which is composed of a central conductor 13 and a dielectric member 12 for coating the central conductor; a drain line 14; and a copper foil 15 for wrapping together the signal and drain lines.

Figure 2:
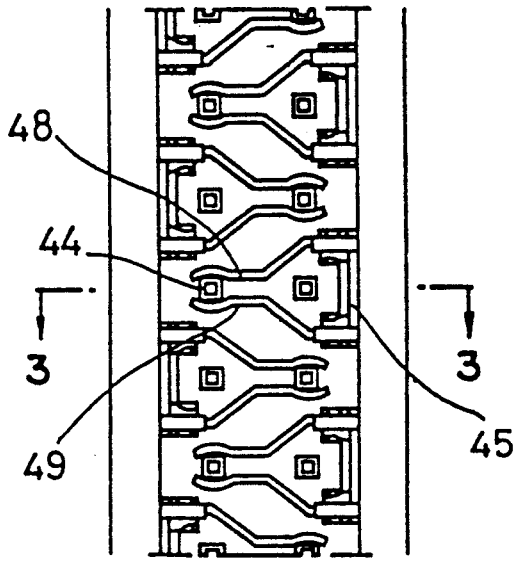
FIG. 2 is a bottom view of a coaxial ribbon connector according to an embodiment of the invention.
Figure 3:
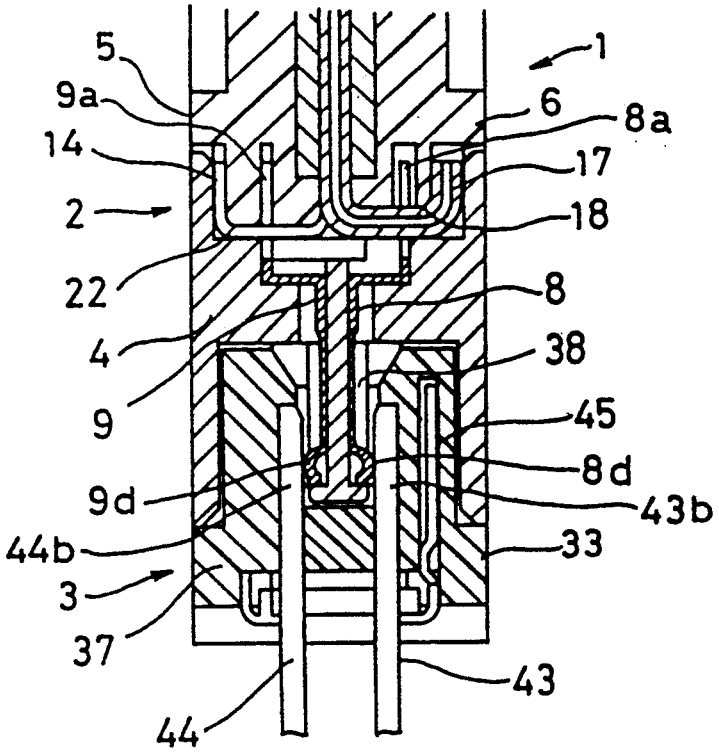
FIG. 3 is a sectional view taken along line 3—3 of FIG. 2.

In FIGS. 2 and 3, a coaxial ribbon cable connector 1 consists of a cable connector 2 and a substrate connector 3.

Figure 4:
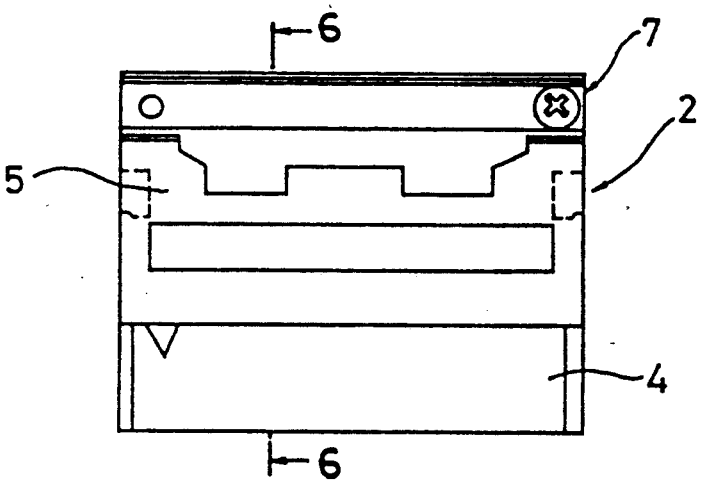
FIG. 4 is a top plan view of a cable connector according to an embodiment of the invention.
Figure 5:
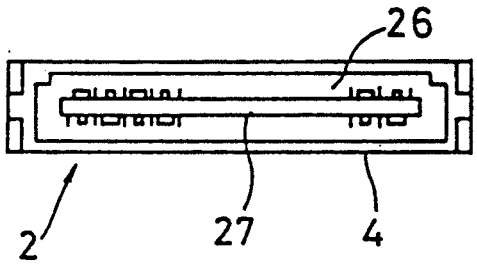
FIG. 5 is a front elevational view of the cable connector.
Figure 6:
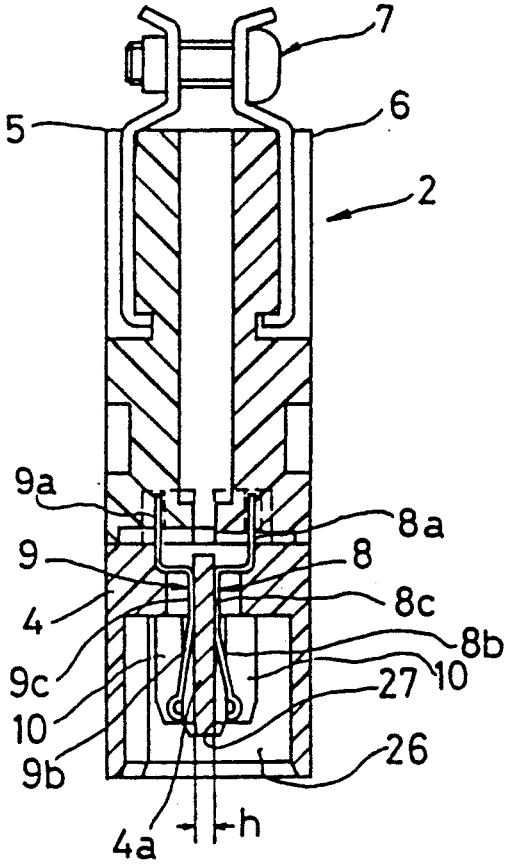
FIG. 6 is a sectional view taken along line 6—6 of FIG. 4.
Figure 7:
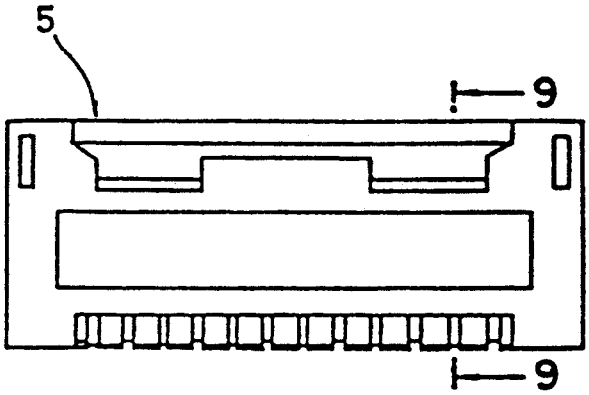
FIG. 7 is a top plan view of a left-hand cover member of the cable connector.
Figure 8:
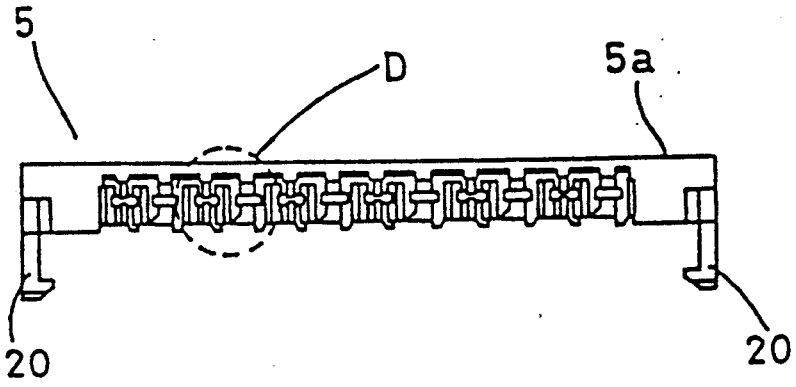
FIG. 8 is a front elevational view of the left-hand cover member.
Figure 9:
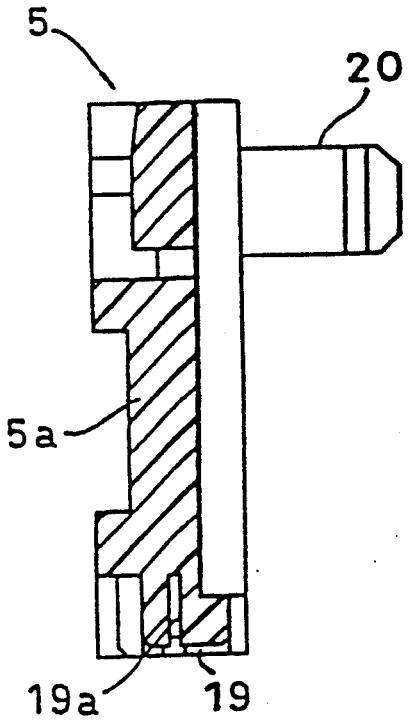
FIG. 9 is a sectional view taken along line 9—9 of FIG. 7.
Figure 10:
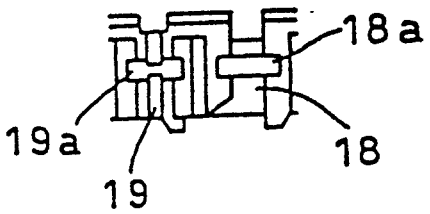
FIG. 10 is an enlarged view of a portion D in FIG. 8.
Figure 11:
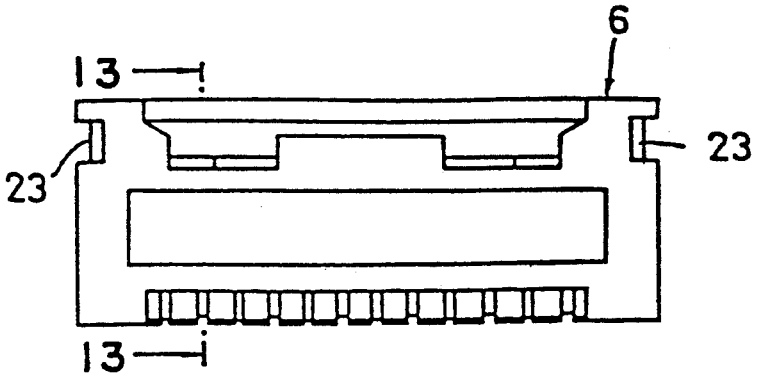
FIG. 11 is a top plan view of a right-hand cover member according to an embodiment of the invention.
Figure 12:
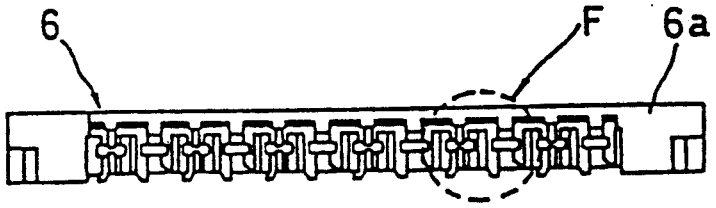
FIG. 12 is a front elevational view of the right-hand cover member.
Figure 13:
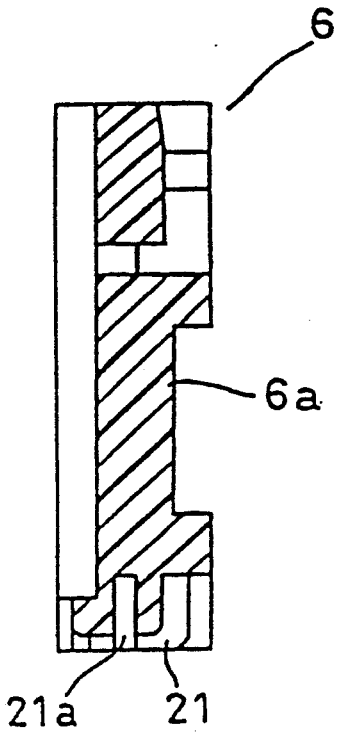
FIG. 13 is a sectional view taken along line 13—13 of FIG. 11.
Figure 14:
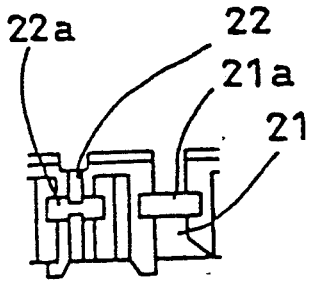
FIG. 14 is an enlarged view of a portion F in FIG. 12.
Figure 15:
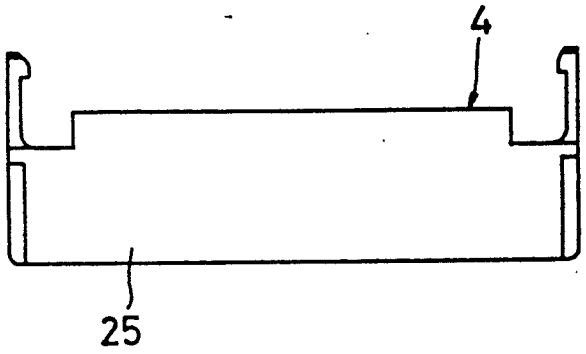
FIG. 15 is a top plan view of an insulating case.
Figure 16:
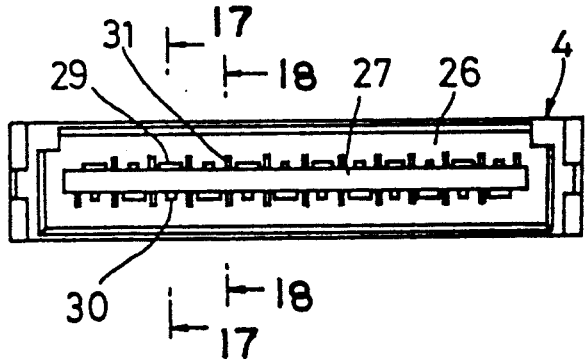
FIG. 16 is a front elevational view of the insulating case.
Figure 17:
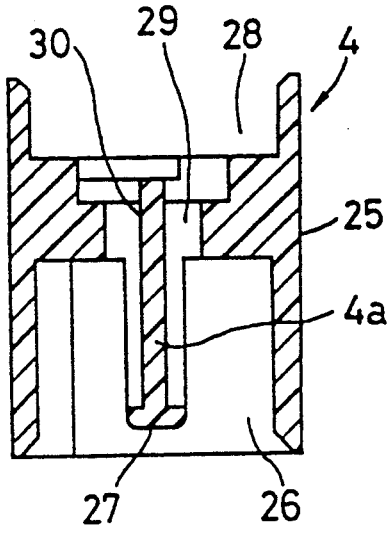
FIG. 17 is a sectional view taken along line 17—17 of FIG. 16.
Figure 18:
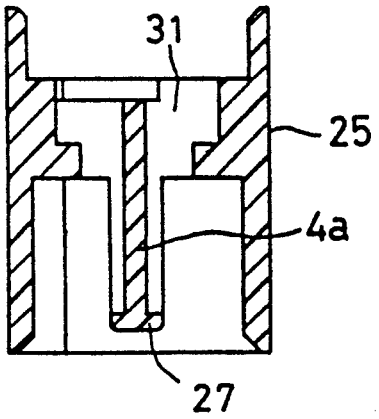
FIG. 18 is a sectional view taken along line 18—18 of FIG. 16.

In FIGS. 4–6, the cable connector 2 consists of an insulating case 4; a pair of cover members 5 and 6, a clamp member 7; and signal terminals 8, ground terminals 9, and shield terminals 10 which are arranged in the insulating case 4.

In FIGS. 7–10, a left-hand cover member 5 includes a rectangular resin block 5*a* which has signal line engaging grooves 18 and drain line engaging grooves 19 formed alternatingly on the front end. Terminal receiving apertures 18*a* and 19*a* are formed the signal and drain line engaging grooves 18 and 19, respectively. A pair of latch arms 20 extend toward a mating cover member from the opposite end portions of the cover member 5*a*.

In FIGS. 11–14, a right-hand cover member 6 includes a rectangular resin block 6*a* which has signal line engaging grooves 21 and drain line engaging grooves 22 formed alternatingly on the front end. Terminal receiving apertures 21*a* and 22*a* are formed in the signal and drain line grooves, respectively. A pair of latch shoulders 23 are formed on opposite ends of the cover member 6*a*.

A length of insulation jacket 16 is removed to expose a shield wires 17. The latch arms 20 of the left-hand cover member 5 are locked with the latch shoulders 23 of the right-hand cover member 6 to hold the coaxial ribbon cable 11 between the cover members 5 and 6, with the copper foil 15 peeled off. Consequently, the signal line engaging grooves 18 and 21 correspond to the drain line engaging grooves 22 and 19, respectively, and the signal line 17 and the drain line 14 of a shielded wire are bent along the signal line engaging groove 18 and the drain line engaging groove 22 while the signal line 17 and the drain line 14 of another shield wire are bent along the signal line engaging groove 21 and the drain line engaging groove 19, respectively. Thus, the signal lines 17 and the drain lines 14 are arranged alternatingly across the cover members 5 and 6.

In FIGS. 15–18, the insulating case 4 includes a rectangular resin block 25 which has a rectangular fitting cavity 26 on the front face and a terminal support 27 extending along the length of the fitting cavity 26. A rectangular recess 28 is formed on the rear face of the resin block 25. Signal terminal mount apertures 29 and ground terminal mount apertures 30 are formed in the rectangular recess 28 on opposite sides of the terminal support 27. The signal terminal mount apertures 29 and the ground terminal mount apertures 30 are arranged alternatingly at regular intervals along the length of the resin block 25. Shield terminal mount apertures 31 are formed in the rectangular recess 26 between pairs of corresponding signal terminal mount aperture 29 and ground terminal mount aperture 20 and extend on opposite sides of the terminal support 27.

In FIG. 6, the signal terminals 8, the ground terminals 9, and the shield terminals 10 are mounted in the signal terminal mount apertures 29, the ground terminal mount apertures 20, and the shield terminal mount apertures 31, respectively. More specifically, the signal terminals 8 are mounted in the insulating case 4 by press-fitting the press-fit portion 8*c* into the signal terminal mount aperture 29 such that the connection portion 8*a* of the insulation-displacement type extends upwardly into the rectangular recess 26 while the straight portion 8*b* extends along the terminal support 27.

The ground terminal 9 is mounted in the insulating case 4 by press-fitting the press-fit portion 9*c* into the ground terminal mount aperture 30 such that the connection portion 9*a* of the insulation-displacement type projects into the rectangular recess 26 while the straight portion 9*b* extends along the terminal support 27. Consequently, there is provided a partition wall 4*a* having a thickness h between the straight portions 8*b* and 9*b* of the signal terminal 8 and the ground terminal 9. In other words, the straight portions 8*b* and 9*b* of the signal and ground terminals 8 and 9 are disposed in a back-to-back relationship across the partition wall 4*a* to form a microstrip line between the signal and ground terminals.

Figure 19:
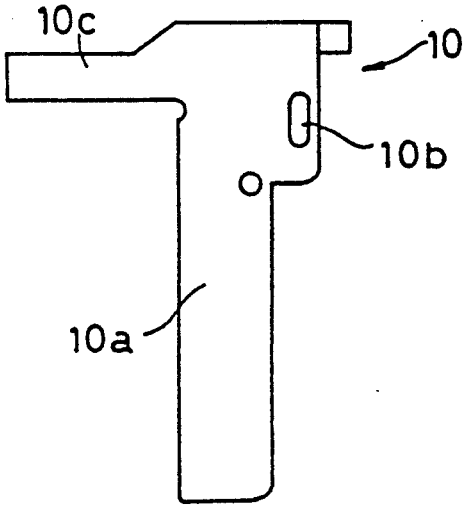
FIG. 19 is a top plan view of a shield terminal.
Figure 20:
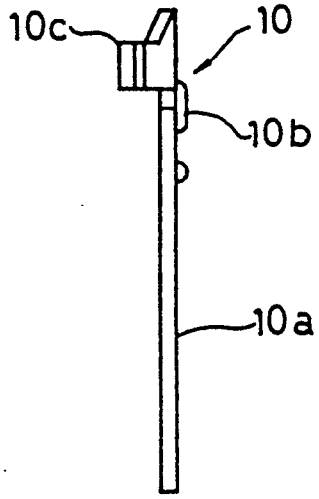
FIG. 20 is a side elevational view of the shield terminal.
Figure 21:
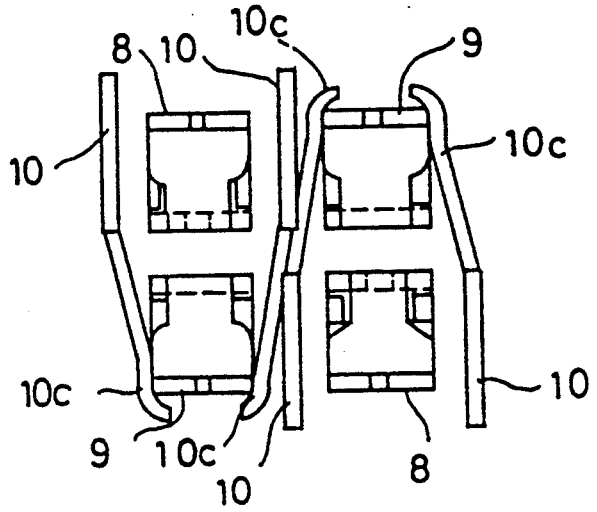
FIG. 21 shows how terminals of the cable connector are arranged.

In FIGS. 19–20, the shield terminal 10 includes a flat shield portion 10*a* having a press-fit portion 10*b* and a short-circuit portion 10*c* extending from the press-fit portion 10*b* at right angles to the shield portion 10*a*. The shield terminal 10 is mounted by press-fitting the press-fit portion 10*b* into the shield terminal mount aperture 31 such that the short-circuit portions 10*c* are brought into contact with the ground terminals 9 while the shield terminals 10 are disposed between the signal terminals 8 to prevent crosstalk between the signal terminals 8 as shown in FIG. 21.

The cable connector 2 is completed by fitting the insulating case 4, in which the respective terminals 8, 9, and 10 are mounted, into the cover members 5 and 6 to connect by insulating displacement the signal lines 17 and the drain lines 14 to the connection portions 8*a* and 9*a* of the signal terminals 8 and ground terminals 9, respectively.

Figure 22:
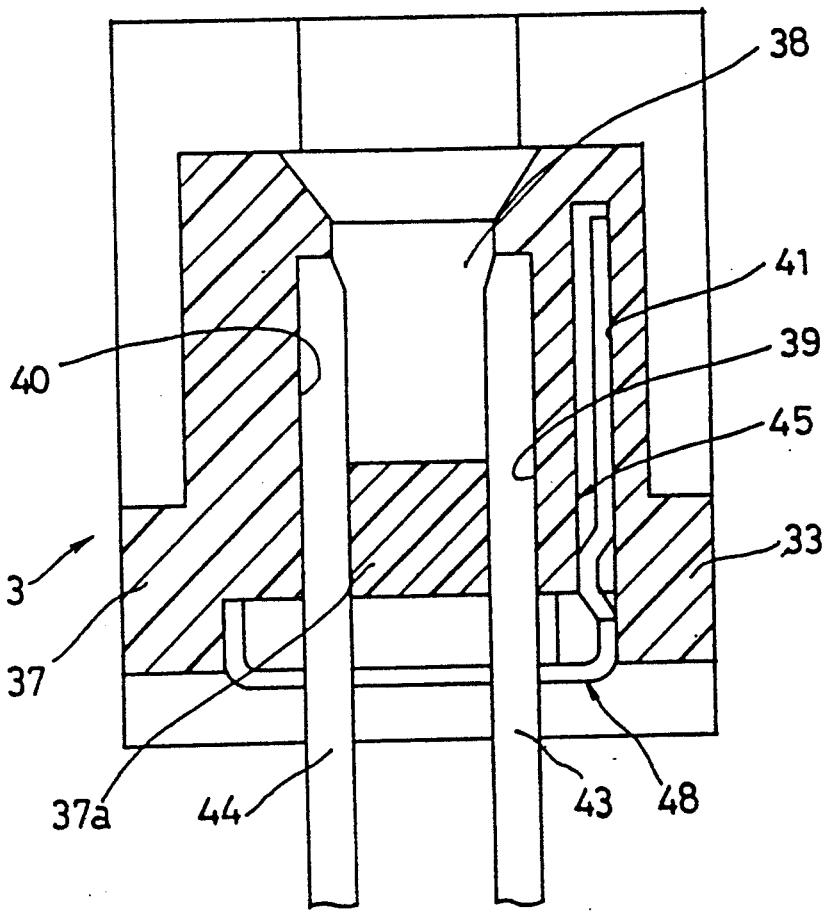
FIG. 22 is a longitudinal section of a substrate connector according to an embodiment of the invention.
Figure 23:
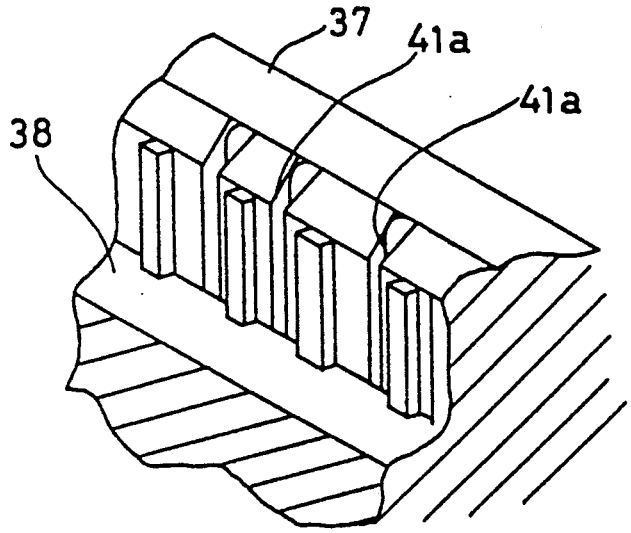
FIG. 23 is a perspective view showing how terminals are arranged in the substrate connector.

In FIG. 22, the substrate connector 3 is composed of an insulating case 33 and signal terminals 43, ground terminals 44, and shield terminals 45 arranged as shown. The insulating case 33 includes a rectangular resin block 37 which has a rectangular fitting cavity 38 on the front face. Signal terminal mount apertures 39 and ground terminal mount apertures 40 are formed on opposed sides of the fitting cavity 38 to extend through the bottom face. The signal and ground mount terminals 39 and 40 are arranged alternatingly at regular intervals along the length of the resin block 37. Shield terminal mount apertures 41 are formed outside the signal terminal mount apertures 39. A pair of terminal grooves 41*a* are formed on opposite sides of each shield terminal mount aperture 41 as shown in FIG. 23.

In FIG. 3, the straight signal terminals 43, the straight ground terminals 44, and shield terminals 45 are mounted on the signal terminal mount apertures 39, the ground terminal mount apertures 40, and the shield terminal mount apertures 41, respectively.

Figure 24:
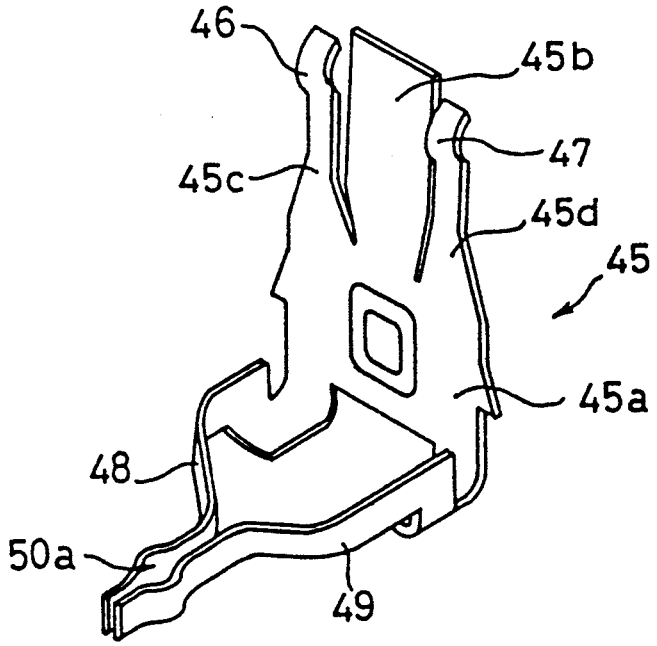
FIG. 24 is a perspective view of a shield terminal according to an embodiment of the invention.

In FIG. 24, the shield terminal 45 includes a flat press-fit portion 45*a*, a shield portion 45*b* extending upwardly from the press-fit portion 45*a*, a pair of contact portions 45*c* and 45*d* extending upwardly from the press-fit portion 45*a* on opposite sides of the shield portion 45*b*. The front portions 46 and 47 of the contact portion 45*c* and 45*d* are curved to form a spring contact. A pair of contact legs 48 and 49 extend from the lower edge of and at right angles to the press-fit portion 45*a*. The front portions of the contact legs 48 and 49 converge to form a terminal contact 50*a*.

The shield terminal 45 is mounted in the insulating case 4 by press-fitting the press-fit portion 45*a* into the shield terminal mount aperture 41 such that the contact portions 46 and 47 are inserted in the terminal grooves 41*a* on opposite sides of the shield terminal mount aperture 41 while the ground terminal 44 is held between the contact legs 48 and 49 as shown in FIG. 2.

Figure 25:
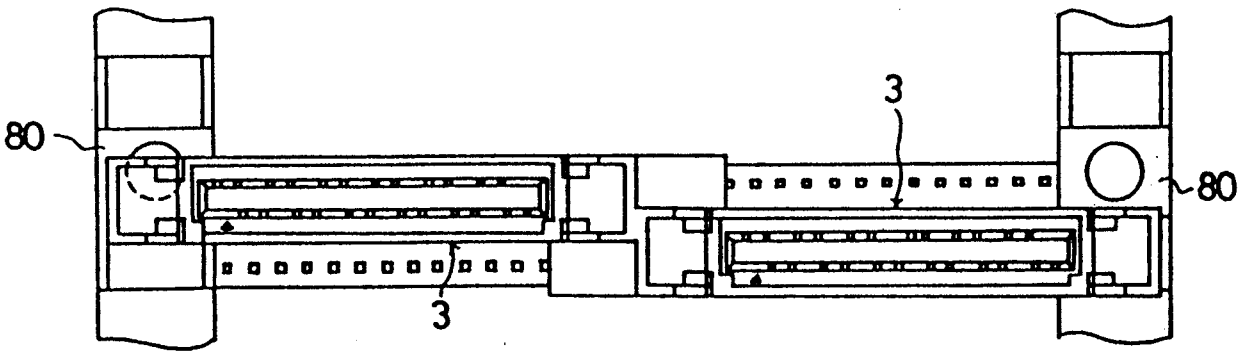
FIG. 25 a top plan view of a pair of substrate connectors mounted on a substrate according to the invention.
Figure 26:
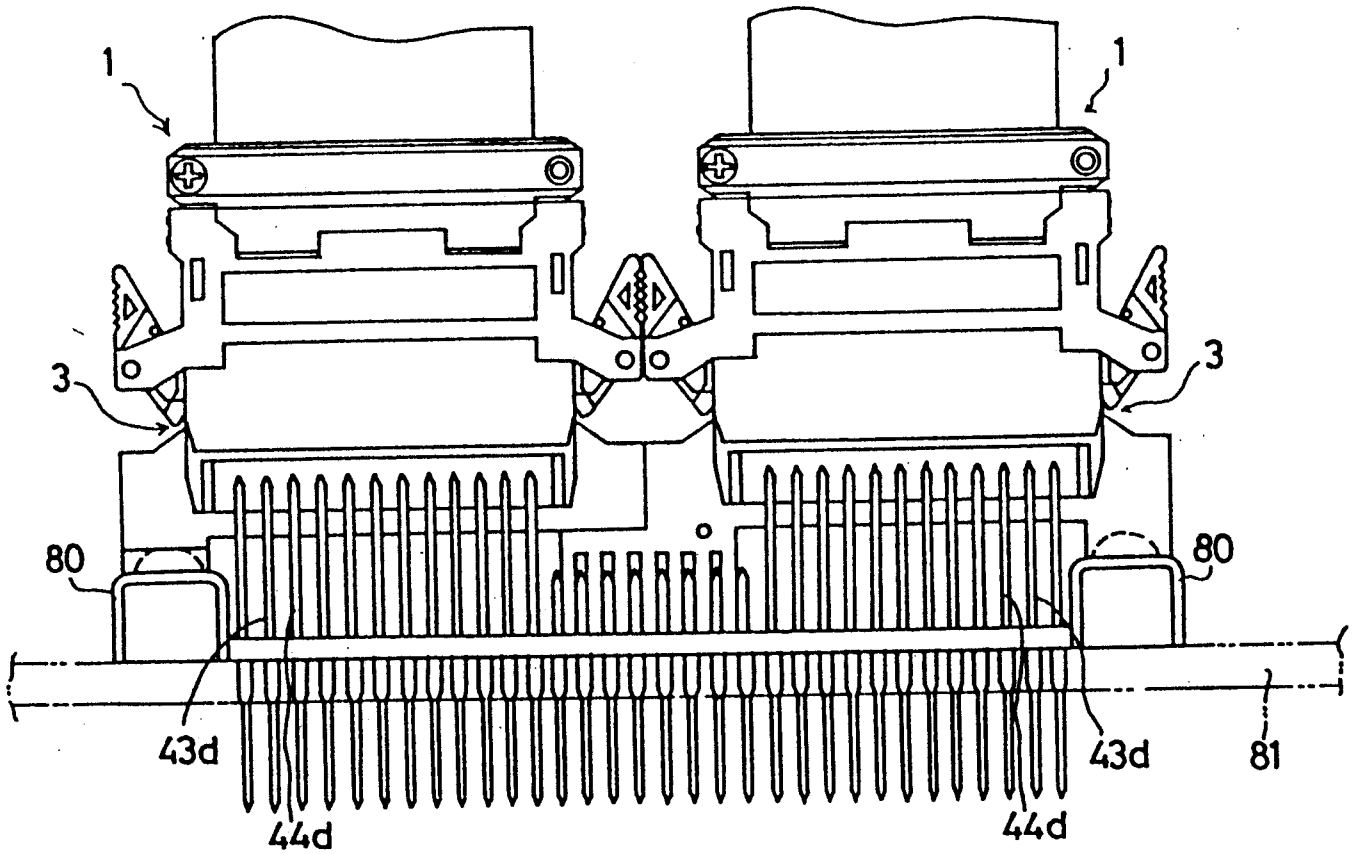
FIG. 26 is a side elevational view of a pair of coaxial ribbon cable connectors mounted on the substrate according to the invention.
Figure 27:
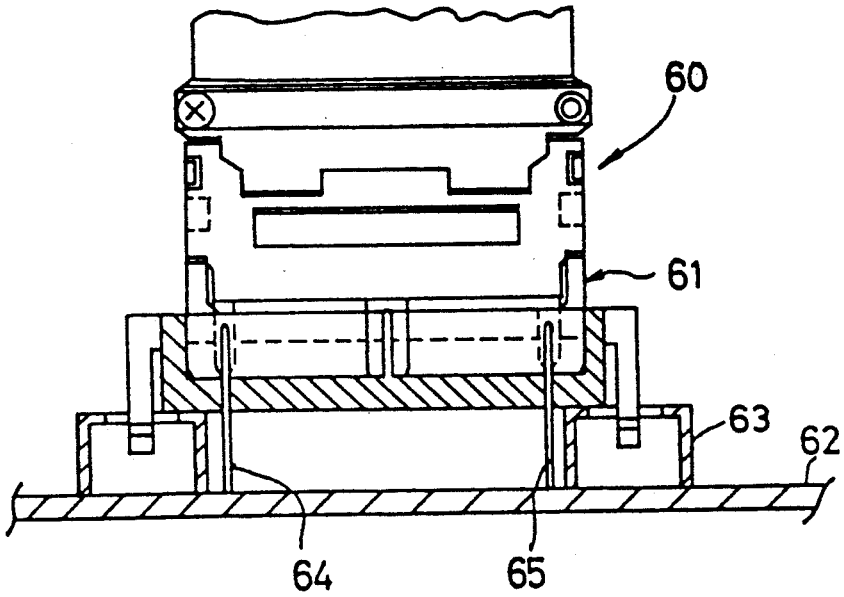
FIG. 27 PRIOR ART
FIG. 27 is a side elevational view of a conventional coaxial ribbon cable connector mounted on a substrate.
Figure 28:
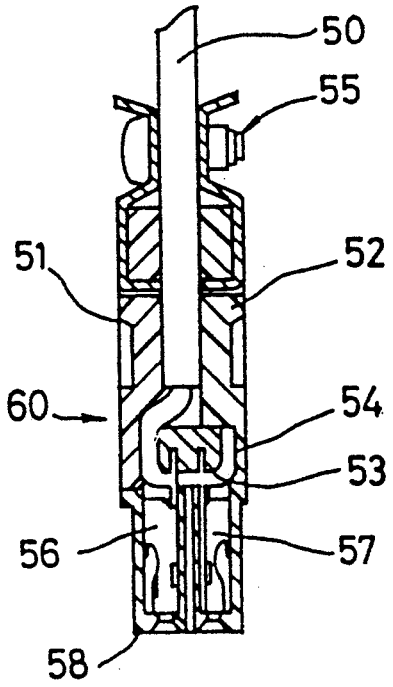
FIG. 28 PRIOR ART
FIG. 28 is a longitudinal section of a conventional cable connector.

In FIGS. 25 and 26, a pair of substrate connectors 3 are mounted on a substrate 81 via mounts 80 such that the respective pin-type legs 43*d* and 44*d* of terminals 43 and 44 of the substrate connectors 3 are inserted through through holes of the substrate 81.

When the cable connector 2 is plugged into the substrate connector 3 as shown in FIG. 3, the contact portions 8*d* and 9*d* of signal terminals 8 and ground terminals 44 on the cable connector 2 are brought into contact with the contact portions 43*b* and 44*b* of signal terminal 43 and ground terminals 44 on the substrate connector 3, respectively. At the same time, the side edges of shield terminals 10 on the cable connector 2 are brought into contact with the contact portions 46 and 47 of shield terminals 45 on the substrate connector 3.

According to the invention it is possible to bring the impedance close to that of a coaxial ribbon cable 11 by disposing the straight portions 8*b* and 9*b* of signal terminals 8 and ground terminals 9 on opposed faces of a partition wall 4*a* to form a microstrip line between the signal and ground terminals. In addition, it is possible to not only prevent crosstalk between signals but also reduce the inductance and the ground noise by disposing shield terminals 10 between the signal terminals 8 such that the shield terminals 10 are brought into contact with the ground terminals 9 via the short-circuit portions 10*c*. Furthermore, since the shield terminals 45 are brought into contact with the ground terminals 44 with the contact legs 48 and 49 on the substrate connector 3, it is possible to prevent crosstalk and reduce the ground inductance and ground noise

We claim:

1. A coaxial ribbon cable connector consisting of a cable connector and a substrate connector, said cable connector comprising:

an insulating case having a partition wall;

a plurality of signal terminals to which signal lines of a coaxial ribbon cable are connected;

a plurality of ground terminals to which drain lines of said cable are connected;

said signal and ground terminals being disposed on said partition wall in a back-to-back relationship to form a microstrip line;

a plurality of shield terminals disposed between said signal terminals and each having a short-circuit portion brought into contact with one of said ground terminal; and said substrate connector comprising:

an insulating case;

a plurality of signal terminals arranged within said insulating case;

a plurality of ground terminals arranged within said insulating case; and said signal, ground, and shield terminals of said substrate connector being brought into contact with said signal, ground, and shield terminals of said cable connector such that shield terminals are connected to said ground terminals via contact legs of said shield terminals when said cable connector is plugged into said substrate connector.

* * * * *